US008777217B2

(12) United States Patent
Watanabe

(10) Patent No.: US 8,777,217 B2
(45) Date of Patent: Jul. 15, 2014

(54) SHEET STACKING DEVICE AND IMAGE FORMING DEVICE

(75) Inventor: Keiichi Watanabe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 89 days.

(21) Appl. No.: 13/227,539

(22) Filed: Sep. 8, 2011

(65) Prior Publication Data

US 2011/0318071 A1 Dec. 29, 2011

Related U.S. Application Data

(63) Continuation of application No. 12/570,658, filed on Sep. 30, 2009, now Pat. No. 8,016,287.

(30) Foreign Application Priority Data

Oct. 17, 2008 (JP) ..... 2008-268429

(51) Int. Cl.
*B65H 31/00* (2006.01)

(52) U.S. Cl.
USPC ..... 271/209; 271/211

(58) Field of Classification Search
USPC ..... 271/209, 161, 145, 207, 211
See application file for complete search history.

(56) References Cited

U.S. PATENT DOCUMENTS 2,426,957 A 9/1947 Trump
4,361,319 A 11/1982 Ikeda et al.
4,720,728 A * 1/1988 Kando ..... 399/405
5,280,897 A 1/1994 Maekawa
5,893,558 A 4/1999 Konig et al.
5,984,299 A * 11/1999 Hirota et al. ..... 271/161
6,015,143 A 1/2000 Jimenez et al.
6,027,269 A * 2/2000 Yoshida ..... 400/625
6,065,747 A * 5/2000 Khovaylo et al. ..... 271/209
6,241,245 B1 6/2001 Hollar et al.
6,701,841 B2 3/2004 Tsurumaki
6,923,438 B2 * 8/2005 Matsuyama et al. ..... 271/207
7,631,864 B1 * 12/2009 Howe et al. ..... 271/207
7,690,641 B2 4/2010 Jowett et al.
7,748,705 B2 * 7/2010 Yamada ..... 271/209
7,931,273 B2 * 4/2011 Mizuguchi ..... 271/214
8,348,263 B2 * 1/2013 Otani et al. ..... 271/213

(Continued)

FOREIGN PATENT DOCUMENTS

EP 611719 A1 8/1994
GB 2017622 A 10/1979

(Continued)

OTHER PUBLICATIONS

Webster's New World Dictionary and Thesauras, Copyright 1996, Simon & Schuster, Inc., p. 666.*

*Primary Examiner* — Prasad Gokhale
(74) *Attorney, Agent, or Firm* — Muncy, Geissler, Olds & Lowe, P.C.

(57) ABSTRACT

A sheet stacking device for stacking conveyed sheets includes a stacking surface on which the sheets are stacked; a plurality of projections that project from the stacking surface. Wherein, the projections extend generally in a travel direction of the sheets, which is a direction in which the sheets travel when entering the sheet stacking device, the projections include outer projections and inner projections, the inner projections are located between the inner projections, and a projecting height of the inner projections from the stacking surface is greater than that of the outer projections.

30 Claims, 9 Drawing Sheets

(56) References Cited

U.S. PATENT DOCUMENTS

| | | | | |
|---|---|---|---|---|
| 8,472,857 | B2 * | 6/2013 | Matsuno | 399/388 |
| 2003/0011126 | A1 | 1/2003 | Miyazawa | |
| 2008/0067737 | A1 * | 3/2008 | Kosuda et al. | 271/207 |
| 2008/0185774 | A1 | 8/2008 | King et al. | |
| 2008/0290590 | A1 * | 11/2008 | Mizuguchi | 271/207 |
| 2009/0206545 | A1 * | 8/2009 | Sunohara | 271/171 |
| 2009/0309294 | A1 * | 12/2009 | Sugizaki et al. | 271/145 |

FOREIGN PATENT DOCUMENTS

| | | | | | |
|---|---|---|---|---|---|
| JP | 58-100060 | A | | 6/1983 | |
| JP | 01064969 | A | | 3/1989 | |
| JP | 01-231755 | A | | 9/1989 | |
| JP | 05008948 | A | | 1/1993 | |
| JP | 06056328 | A | * | 3/1994 | B65H 31/02 |
| JP | 6056328 | A | * | 3/1994 | B65H 31/02 |
| JP | 06156853 | A | | 6/1994 | |
| JP | 08-091672 | A | | 4/1996 | |
| JP | 10-250894 | A | | 9/1998 | |
| JP | 2000-313561 | A | | 11/2000 | |
| JP | 2001-063901 | A | | 3/2001 | |
| JP | 2004-010188 | A | | 1/2004 | |
| JP | A-2006-53508 | | | 2/2006 | |

* cited by examiner

SHEET STACKING DEVICE AND IMAGE FORMING DEVICE

CROSS REFERENCE TO RELATED APPLICATION

This application is a continuation of U.S. application Ser. No. 12/570,658 filed on Sep. 30, 2009, which is based on and claims priority to Japanese Patent Applications No. 2008-268429, filed on Oct. 17, 2008.

TECHNICAL FIELD

The present application relates to a sheet staking device and image forming device in which projections support discharged sheets to facilitate cooling of the discharged sheets.

BACKGROUND

Conventionally, image forming devices of an electrophotographic system, such as a printer, facsimile machine, photocopier, and multi function printer (MFP), form a toner image on a sheet by a photoreceptor drum and a transferring roller that is in contact with the photoreceptor drum. Further, the image forming devices heat and fuse the toner image on the sheet by a fusing unit that is configured with a heating roller and pressing roller that is pressed into contact with the heating roller. The sheet on which the toner image is formed by the fusing unit is carried to and stacked on a sheet discharge tray, which is located outside the image forming device.

In such a configuration, the size of the image forming device may be reduced by locating the fusing unit in the vicinity of and below the sheet discharging tray. Further, friction, which interferes with smooth movement of the discharged sheet, is reduced by forming multiple projections (or ribs) on an upper surface of a base of the sheet discharge tray. See Japanese laid-open patent publication No. 2006-053508.

However, in these conventional image forming devices, the fusing unit is close to the sheet discharging tray. Therefore, heat generated in the fusing unit tends to heat the sheet discharging tray. Consequently, sheets discharged on the sheet discharge tray may become attached each other by re-fusing of toner as a result of two types of heat. One is heat remaining in sheets just after the toner images are fused, and the other is heat that the sheet discharging tray maintains by itself.

The present application aims to resolve the deficit(s).

SUMMARY

In order to resolve the deficit(s), the present application discloses a sheet stacking device for stacking conveyed sheets includes a stacking surface on which the sheets are stacked; a plurality of projections that project from the stacking surface. Wherein, the projections extend generally in a travel direction of the sheets, which is a direction in which the sheets travel when entering the sheet stacking device, the projections include outer projections and inner projections, the inner projections are located between the inner projections, and a projecting height of the inner projections from the stacking surface is greater than that of the outer projections.

According to the disclosure of the present application, the sheet stacking device has a plurality of projections on a stacking surface. Among these projections, inner projections are to be higher than outer projections. The projections improve ventilation of the stacking device so that the discharged sheets are cooled earlier than in the conventional device. This prevents discharged sheets from attaching to each other (by the re-fusing action) as a result of the above-described heat.

BRIEF DESCRIPTION OF DRAWINGS

FIG. 4A shows a sectional view taken by B-B arrows in FIG. 1. FIG. 4B shows a sectional view taken by C-C arrows in FIG. 1.

DETAILED DESCRIPTION OF THE PREFERRED EMBODIMENTS (First embodiment) FIG. 2 shows an image forming device 10. The image forming device 10 is, for example, a printer, facsimile machine, photocopier, multi function printer (MFP), or the like. The device 10 can be any type of image forming device that is able to form an image on a sheet, such as a printing sheet, an envelope, an over head projector sheet (OHP sheet) or the like, using an electrophotographic method. The image forming device 10 may form only black and white images (monochrome image) or may form colored images. Hereinafter, the image forming device is described as a printer forming black and white images The image forming device 10 includes a sheet cassette 12, a pickup roller 13, a sheet feeding roller 14, a retard roller 15, a carrying roller 16, a driven roller 17, a pressure roller 18, a registration roller 19(or a roller for a sheet alignment), a printing head 20, an image forming part 21, a photoreceptor drum 22, a transferring roller 23, a heat application roller 24, a pressure application roller 25, a driven roller 26, a carrying roller 27, a driven roller 28, a discharge roller 29, and a sheet stacking device 30, or delivery tray.

Figure 1:
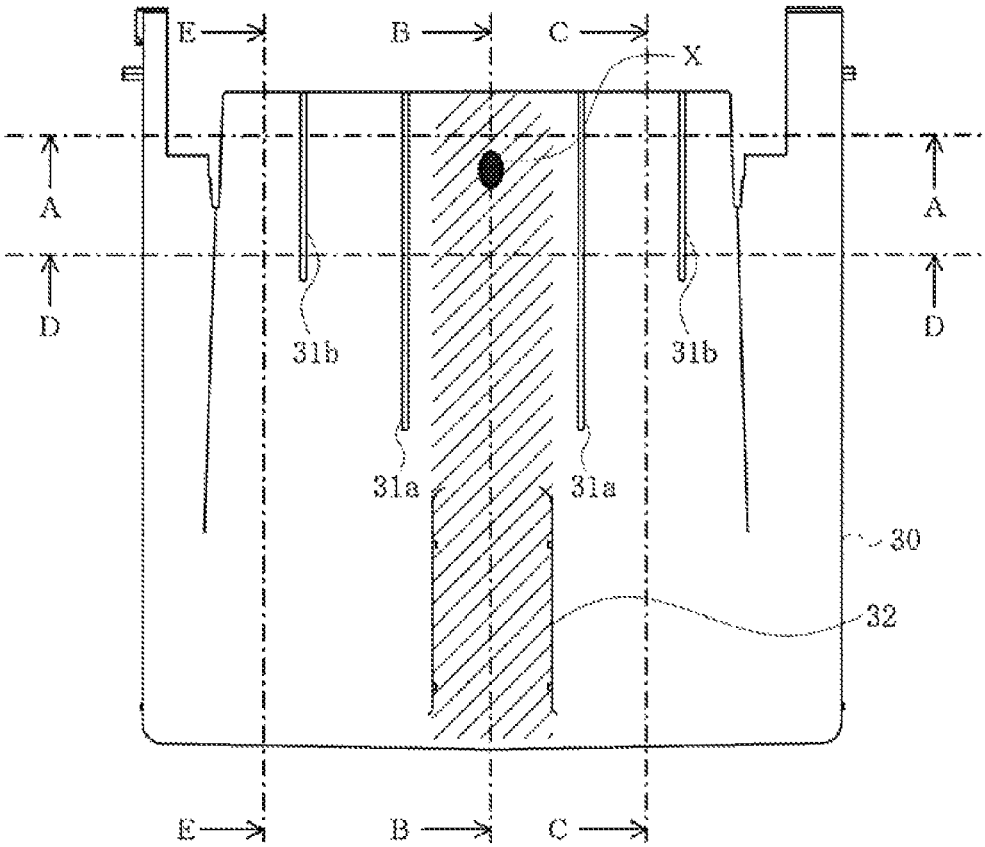
FIG. 1 is a plan view illustrating a sheet stacking device of the first embodiment.

The sheet cassette 12 is located at a lower part of a body of the image forming device 10 and accommodates sheets 33 as media on which images have not yet been printed. The sheets are stacked in a vertical stack in the sheet cassette 12. A sheet separating device is located at a sheet feeding part that is opposed to the sheet cassette 12. The sheet separating device is assembled with the pickup roller 13, the sheet feeding roller 14, and the retard roller 15. Herein, the pickup roller 13 is configured to press the sheets 33 that are raised up to a predetermined height and to feed the sheets 33. The sheet feeding roller 14 functions as an isolating means and is able to isolate (or separate) a single sheet 33, and the retard roller 15 is equipped with a torque limiter.

The sheets 33 are separated and fed (supplied) sheet by sheet with the sheet feeding apparatus. The separated media 33 are carried to the carrying roller 16 and driven roller 17. The carrying roller 16 and driven roller 17 are rollers for carrying the media 33 and form a pair of pinch rollers. The sheets 33 are carried to the pressure roller 18 and registration roller 19 by the carrying roller 16 and driven roller 17. The pressure roller 18 and registration roller 19 convey the sheets 33 to the image forming part 21 and form a pair of pinch rollers.

The image forming part 21 is a generic name for parts including a charge roller, a developing roller, a toner regulatory member, a cleaning device and the like. The image forming part 21 is detachable from the body of the image forming device 10. The transferring roller 23 is opposed to the photoreceptor drum 22. A toner image formed on a surface of the photoreceptor drum 22 is transferred to a surface of one of the sheets 33 by cooperation between the photoreceptor drum 22 and the transferring roller 23.

The printing head 20, or exposing means, forms multiple dots with lights generated by light emitting diodes (LED) or a laser beam. The printing head 20 selectively irradiates the surface of the photoreceptor drum 22, which is charged by the charge roller, so that an electrostatic latent image is formed on the surface of the photoreceptor drum 22. Toner is delivered onto the photoreceptor drum 22 by the developing roller so that the electrostatic latent image is developed and the toner image is formed.

On a downstream side of the photoreceptor drum 22, a fuser is located to apply heat and fuse the toner image transferred on the sheet 33. The fuser is equipped with the heat application roller 24 and the pressure application roller 25, which form a pair of pinch rollers. When the sheet 33 on which the toner image is transferred is conveyed between the heat application roller 24 and pressure application roller 25, the toner image is fused on the sheet 33 as a result of the heat and pressure.

After that, the sheets 33 are carried to an outlet 34. The driven roller 26 and carrying roller 27 form a pinch roller pair for conveying sheets 33 to the outlet 34. The sheets 33 are discharged from the device with the driven roller 28 and discharge roller 29, which form a pinch roller pair. The sheets are thus carried to and stacked on the sheet stacking device 30.

The following is a description of the stacking device 30.

Inner projections 31*a* and outer projections 31*b* are formed on the sheet stacking device 30. The projections 31*a* and 31*b* are fin-like and are formed to extend in the moving direction of the sheets 33; that is, in a direction that is orthogonal to the axis of the discharge roller 29. In this embodiment, the projections 31*a* and 31*b* are parallel, as shown in FIG. 1. The outer projections 31*b* are positioned at opposite, outer sides of the sheet stacking device. In other words, the outer projections 31*b* are arranged correspond in position generally to lateral margins of the sheets 33. The inner projections 31*a* are positioned in a center region of the sheet stacking device 30, between the outer projections 31*b*. The inner projections 31*a* are relatively long. On the other hand, the outer projections 31*b* are relatively short compared with the inner projections 31*a*.

As shown in FIG. 1, the sheet stacking device 30 has a trench 32, or channel, in a central part of the stacking device extending in the longitudinal direction of the stacked sheets 33. The trench 32 extends in the direction of a longitudinal axis of the sheet stacking device 30, as shown in FIG. 1. In the embodiment of FIG. 1, the depth of the trench 32 is 7 mm.

Figure 3:
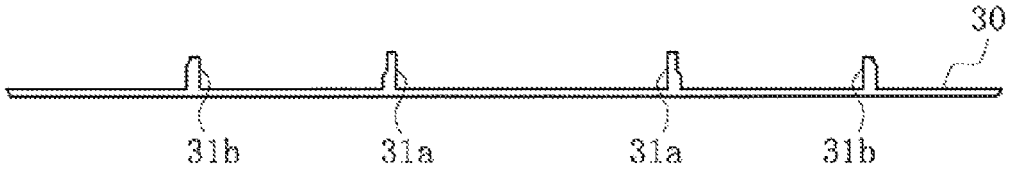
FIG. 3 is a sectional side view illustrating the structure of the sheet stacking device of the first embodiment, as viewed from the plane indicated by line A-A in FIG. 1.

As FIG. 3 illustrates, the inner projections 31*a* are higher than the outer projections 31*b*. That is, the height of the inner projections 31*a*, which is measured from the surface of a base of the sheet stacking device 30, is greater than the height of the outer projections 31*b*, as measured from the surface of the base of the sheet stacking device 30. The outer projections 31*b* are lower than the inner projections 31*a* because the lateral edges of the sheets 33 passing through the fuser and on which a toner image has been fused are often curled in the longitudinal direction of the sheets 33, and the different projection heights of the projections 31*a*, 31*b* helps to remove the longitudinal curl.

Figure 4A:
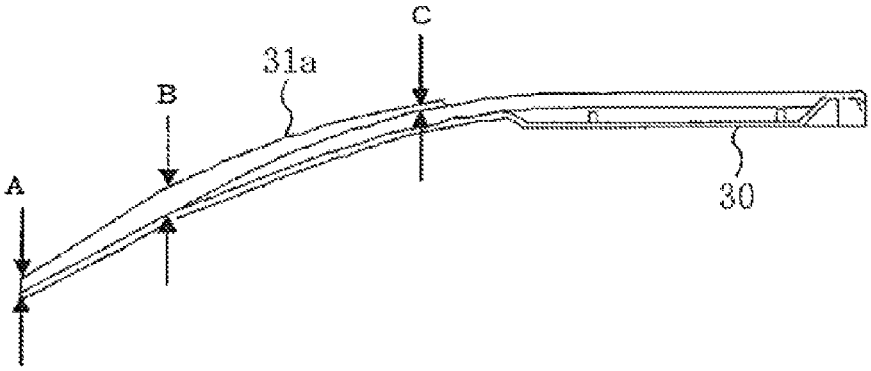
FIGS. 4A and 4B are sectional views illustrating the structure of the sheet stacking device of the first embodiment. More particularly.

FIG. 4A illustrates the inner projections 31*a* of the first embodiment. The height of the inner projections 31*a* is 5 mm at position A, 8 mm at position B, and 3 mm at position C.

The height of the inner projections 31*a* at position A is 5 mm considering of the stacking volume of the sheets 33. That is, the height of the inner projections 31*a* varies according to the types of sheets 33 being used. In case where the sheets 33 are paper of which a ream weight (1000 sheet unit weight) is 201*b*, the 1 mm height of the projection right below the outlet 34 1 mm is estimated (equaled to) ten sheets of the sheets 33 that are stacked. The position A is located right below the outlet 34. Therefore, the height of the inner projections 31*a* at position A is 5 mm so that the ventilation function of the inner projections 31*a* is guaranteed.

The height of the inner projections 31*a* at position B is 8 mm, which is the maximum height of the projections 31*a*, 31*b*. Position B has the maximum projection height because the heat application roller 24 is located directly below position B. At position B, the stacked sheets 33 have the highest temperature because the sheet stacking device 30 is heated by heat transferred from the fuser. In addition, heat remaining at the trailing end of the sheets 33, which corresponds to the left end of the stacking device 30 in FIG. 1, and heat transferred from the sheet stacking device 30 accumulates at position B.

Figure 2:
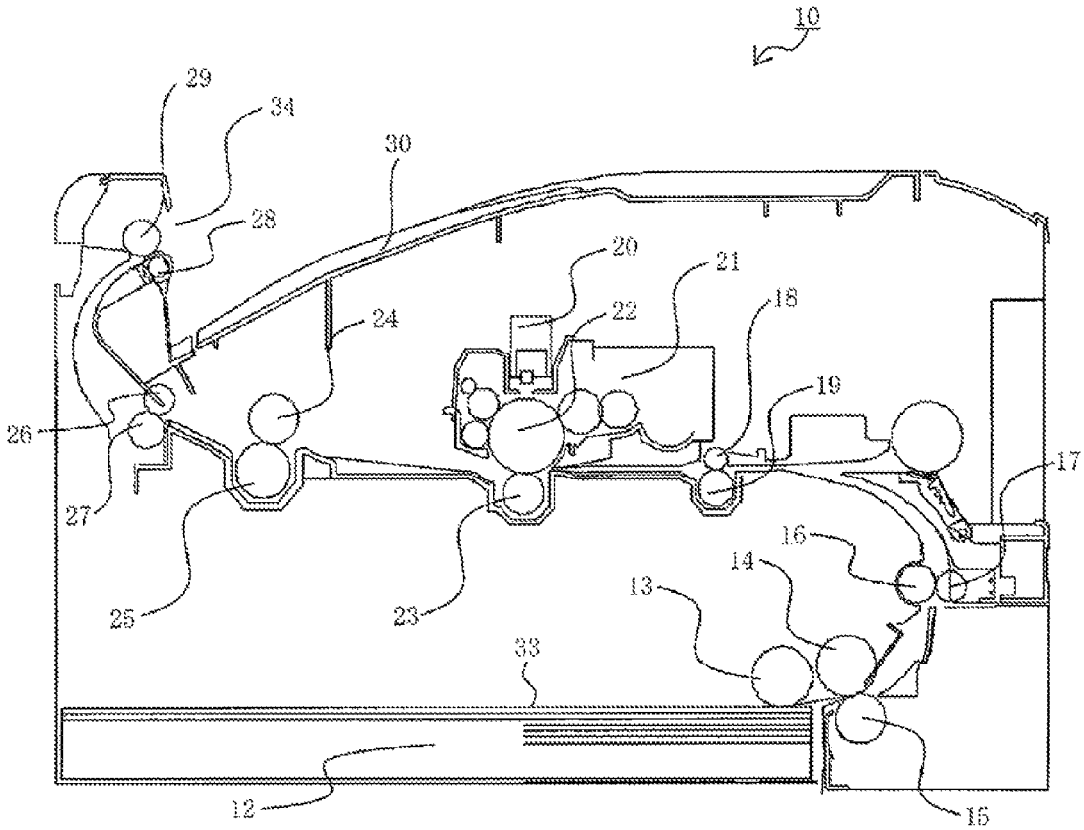
FIG. 2 is a side view illustrating the structure of an image forming device of the first embodiment.

The height of the inner projections 31*a* at position C is 3 mm. The height of the inner projections 31 a at position C does not significantly affect the temperature of the sheets 33, even if the height is set very low toward the upper end (the right end as seen in FIG. 2) of the sheet stacking device 30. The leading end, or far end, of the sheets 33 is naturally cooled relatively more than the near end, or trailing end, and the temperature of the leading end of the stack tends to be relatively low. The longitudinal dimension of the inner projections 31*a* is 160 mm.

Figure 4B:
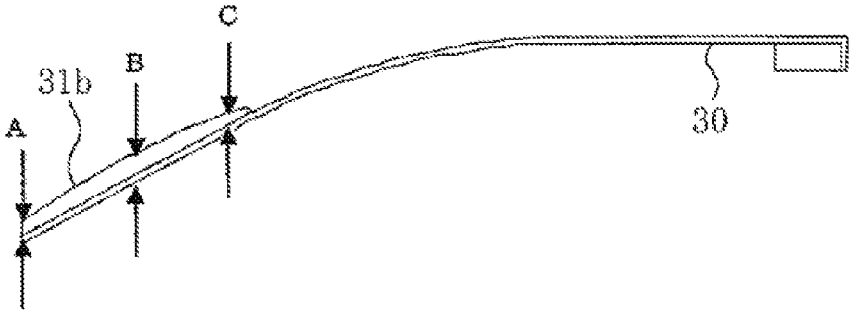

FIG. 4B illustrates the configuration of the outer projections 31*b*. The outer projections 31*b* extend in the longitudinal direction, but are shorter than the inner projections 31*b* in the longitudinal direction. The height of the outer projections 31*b* at position A is 5 mm, which is the same as the height of the inner projection 31*a* at that position. The height of the outer projections 31*b* at position B is 7 mm, in view of the curl of the sheets 33. The height of the outer projections 31*b* at position C is 3 mm. The longitudinal dimension of the outer projections 31*b* is 80 mm.

The following is a description of the operation of the image forming device 10.

As shown in FIG. 2, the sheet cassette 12 accommodates multiple stacked sheets. When, the image forming device 10 starts an operation to form an image, one of the sheets 33 is carried up to the sheet feeding roller 14, and certainly fed one at a time with the sheet feeding roller 14 and retard roller 15. With the configuration, a sheet is taken from the sheet cassette 12, the sheet 33 is transferred to the registration roller 19 with the carrying roller 16 and the driven roller 17. The carrying roller 16 and driven roller 17 mainly function to reduce the burden on the sheet 33 during travel along the sheet path having a cylindrical shape.

Then, the sheet 33 is carried up to the image forming part 21 with the registration roller 19 and pressure roller 18. At the image forming part 21, a charge roller charges the surface of the rotating photoreceptor drum 22. When portions that were negatively charged come below the printing head 20, the printing head 20 is exposes the drum 22 so that an electrostatic latent image is formed at the charged portions based on the image data. The developing roller develops the electrostatic latent image so that the image becomes a toner image. The toner image is transferred to the sheet 33 that is carried by the transferring roller 23.

Next, the transferred toner image on the sheet 33 is processed under high pressure and high temperature conditions when the sheet 33 that was carried to the fuser passes through the heat application roller 24 and pressure application roller 25. As a result, the toner image is fused on sheet 33 by the heat and pressure.

After that, the sheet 33 on which the toner image has been fused is carried up to the outlet 34 with the driven roller 26 and carrying roller 27. Then, the sheet 33 is discharged on the sheet stacking device 30 with the discharging roller 29 and driven roller 28.

The following describes the factors affecting the temperature of the stacked sheets 33 on the sheet stacking device 30.

Figure 5:
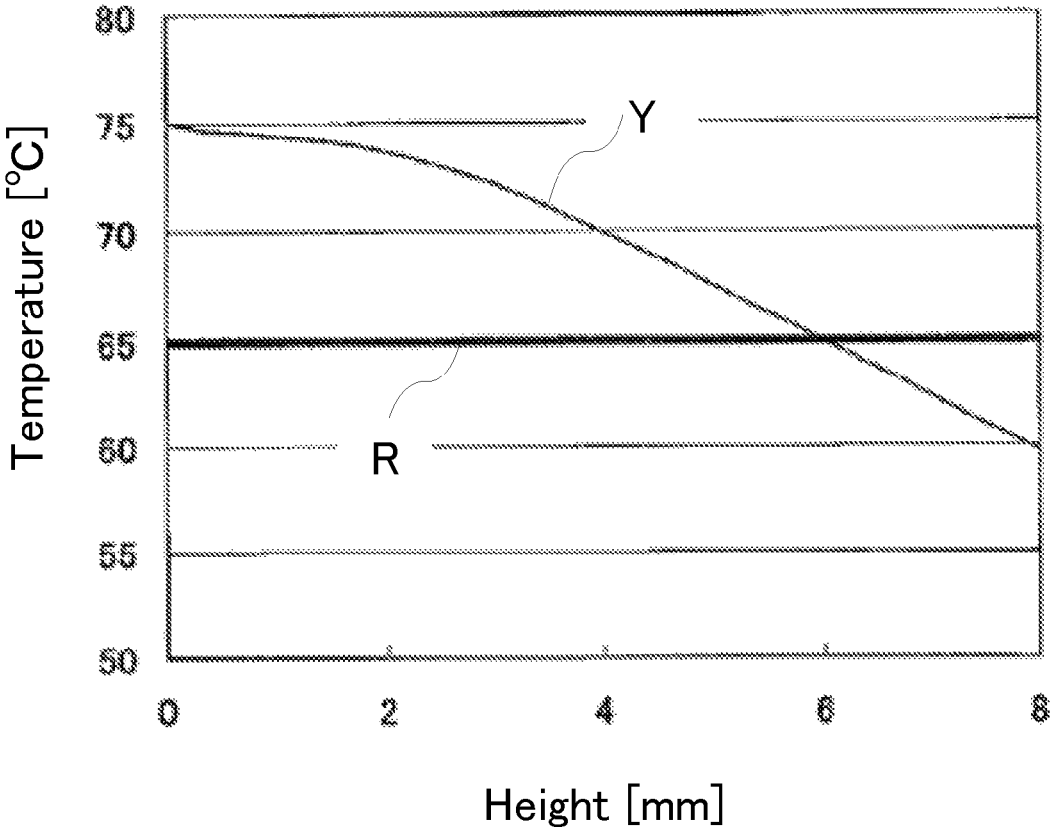
FIG. 5 is a graph illustrating the relationship between the height of projections and temperature in the first embodiment.
Figure 6A:
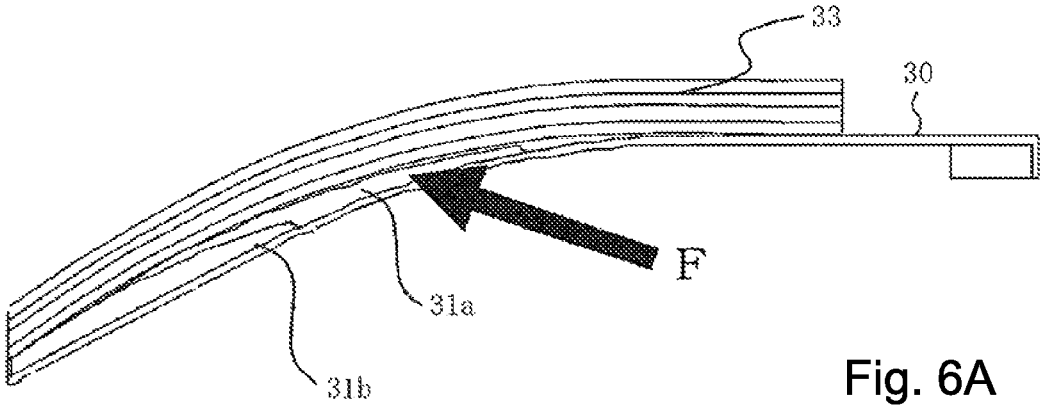
FIGS. 6A and 6B are sectional views illustrating the sheet stacking device on which sheets are stacked in the first embodiment, as viewed from plane E-E in FIG. 1.
Figure 6B:
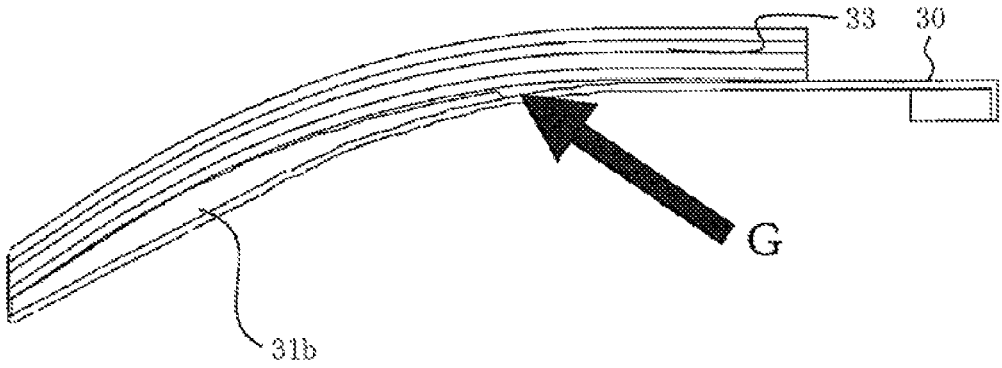
Figure 7:
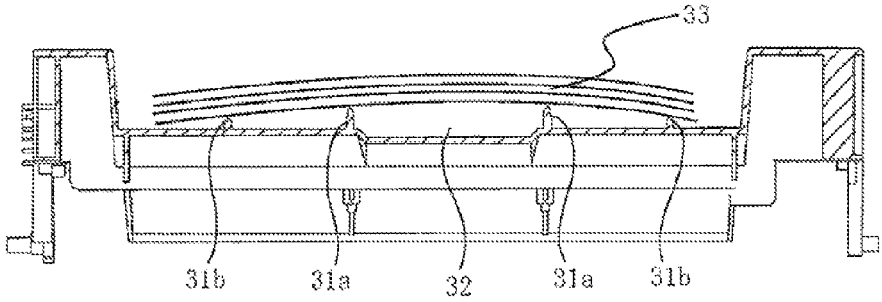
FIG. 7 is a sectional view illustrating the sheet stacking device on which sheets are stacked in the first embodiment, as viewed from plane D-D in FIG. 1
Figure 8:
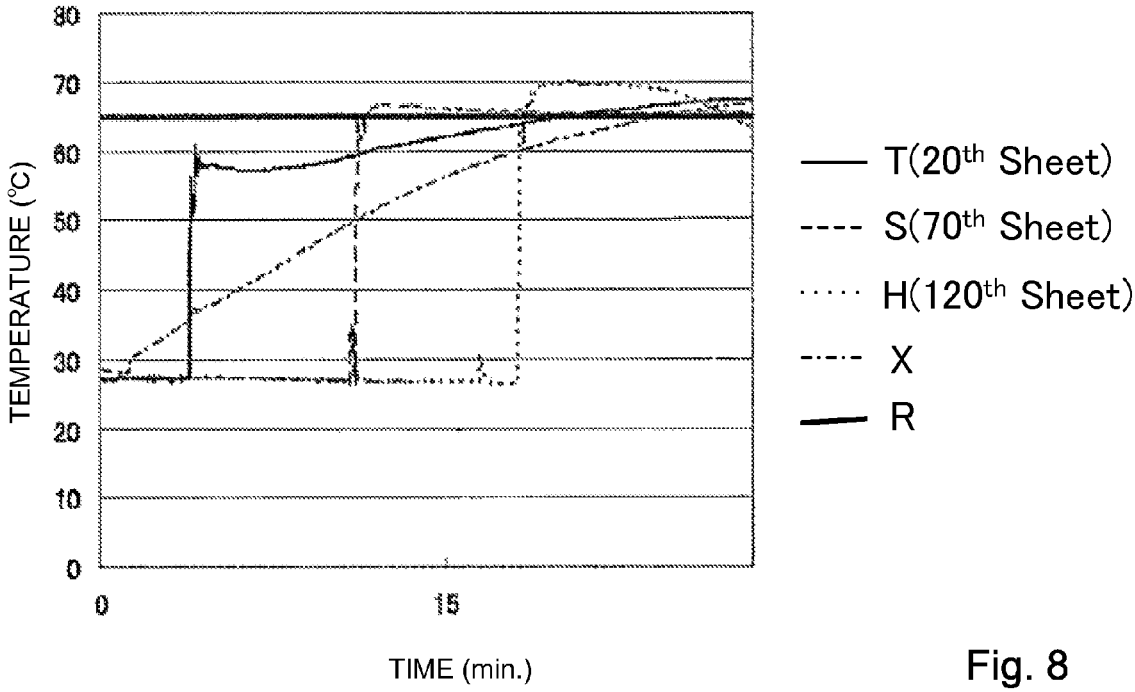
FIG. 8 is a first graph illustrating the relationship between temperature changes of the sheet stacking device and time in the first embodiment.
Figure 9:
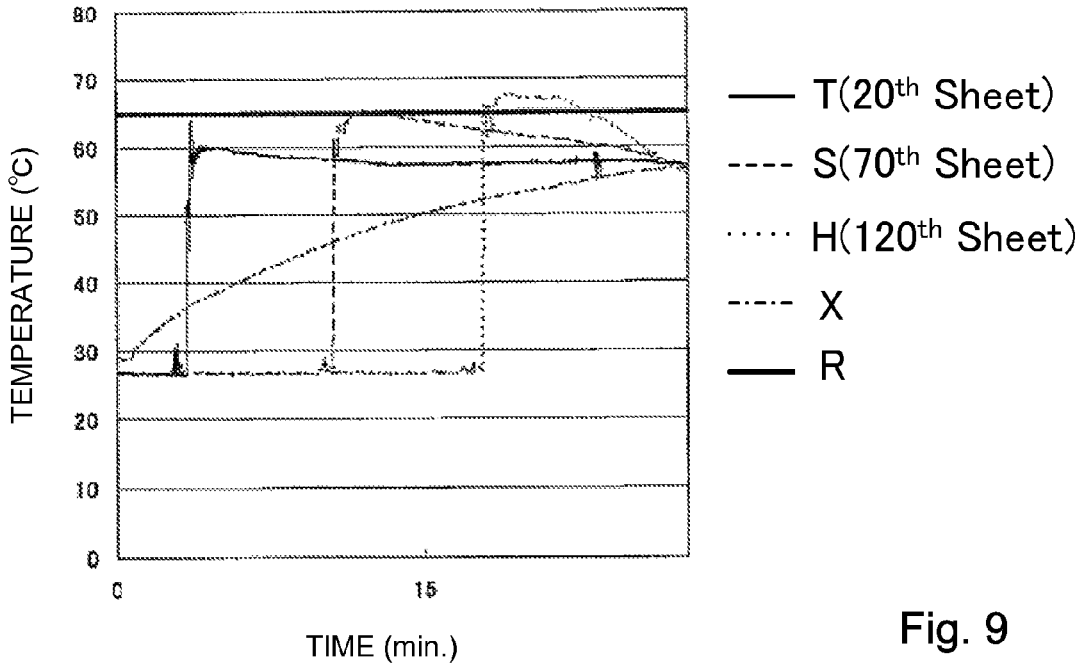
FIG. 9 is a second graph illustrating the relationship between temperature changes of the sheet stacking device and time in the first embodiment.

FIG. 5 illustrates the relationship between the heights of the projections and the temperature of the sheet stacking device 30 of the first embodiment. FIGS. 6A and 6B are sectional views illustrating the sheet stacking device 30 on which sheets are stacked in the first embodiment, as viewed from plane E-E in FIG. 1. FIG. 6A illustrates a configuration in which the heights of the projections 31*a*, 31*b* differ. On the other hand, FIG. 6B illustrates a configuration in which the heights of the projections 31*a*, 31*b* are the same. FIG. 7 is a sectional view illustrating the sheet stacking device 30 on which sheets are stacked in the first embodiment, as viewed from plane D-D in FIG. 1. FIG. 8 is a first graph illustrating temperature changes of the sheet stacking device 30 with time in the first embodiment. FIG. 9 is a second graph illustrating temperature changes of the sheet stacking device 30 with time in the first embodiment. In FIGS. 8 and 9, the horizontal axis represents time, and the vertical axis represents temperature.

As described above, the image forming device 10 includes a fuser equipped with the heat application roller 24, with which a transferred toner image is fused on a sheet 33. The heat application roller 24 is located below and in the vicinity of the sheet stacking device 30. When the image forming device 10 conducts a printing process, or an image forming operation, the fuser conducts the fusing process under high temperature and pressure conditions. The leading ends of the discharged sheets 33 from the outlet 34 travel to the far end of the sheet stacking device 30 (the upper end, or the right end in FIG. 2). On the other hand, the trailing ends of the sheets 33 lie directly below the discharge roller 29.

The leading ends of the sheets 33 are exposed to air for a relatively long period during movement to the far end of the stacking device 30 after being discharged from the outlet 34. Therefore, the temperature of the sheets 33 apparently drops when the sheets 33 reach the stacked position. On the other hand, the trailing ends of the sheets 33 reach the stacked position soon after exiting from the outlet 34. Therefore, the trailing ends not have as much time to be exposed to the air in order to be cooled compared to the leading ends. As the result, the trailing ends of the sheets 33 tend to be relatively warmer than the leading ends in the discharge stack that rests on the stacking device 30.

As a result, in a case of a continual printing, the trailing ends of the sheets 33 tend to become attached to one another due to re-fusing caused by the higher temperature at the trailing end of the stacked sheets.

At the sheet stacking device 30, the projections 31*a* and 31*b* extend generally in the longitudinal direction. The projections 31*a* and 31*b* cause an air layer to form between the base of the sheet stacking device 30 and the bottom sheet of the stacked sheets 33. The air layer facilitates air cooling of the discharged stack of sheets 33.

As shown in FIG. 1, the trench 32 is located at the part of the sheet stacking device 30 that is shaded by hatch marks. The trench 32 is longer than the longitudinal dimension of the sheets 33. With this configuration, air flows between the projections 31*a* through the trench 32 so that the sheets 33 are cooled more effectively. The air flows in a longitudinal direction of the sheets 33. Without the trench 32, little air enters between the projections 31*a* because the projections 31*a* block the air flow in the lateral direction of the sheets 33 (or width direction).

FIG. 5 shows temperatures measured at the sheet stacking device 30 in order to determine the heights of the projections 31*a*, 31*b* at several positions. The curved line Y represents measured temperatures; the horizontal line R represents toner re-fusing temperatures. The inventor of the present application placed a K-type thermocouple sensor at position X in FIG. 1 so that the maximum temperature of the sheet stacking device 30 was measured. Then, the relationship between the heights of the projections 31*a*, 31*b* and the temperature of the sheet stacking device 30 was obtained. According to the result shown in FIG. 5, the temperature of the sheet stacking device 30 generally has an inversely proportional relationship with the height of the projections 31*a*, 31*b*. In other words, as the height of the projections 31*a*, 31*b* increases, the temperature decreases. According to the result shown in FIG. 5, when the height reaches 6 mm, the line Y crosses the line R, which means that the temperature at 6 mm is the toner re-fusing temperature. As the height increases, the line Y falls below the line R, which means that the temperature is below the toner re-fusing temperature.

In a case where there were no outer projections 31*b*, that is, there were only the inner projections 31*a* with heights of 6 mm, large parts of the sheets 33 in the width direction contacted the sheet stacking device 30. Near the trailing edges of the sheets 33, re-fusing occurred in areas other than the area between the projections 31 a in the width direction.

As FIG. 6A shows, in a condition where the length of the outer projections 31*b* is less than the length of the inner projections 31*a*, a gap between the sheets 33 and the sheet stacking device 30 is formed. The gap forms a space for air intake. In FIG. 6A, the space is indicated with an arrow F. For the outer projections 31*b* to raise the trailing end of the sheets 33 and make the air intake space, the outer projections 31*b* must have at least a certain minimum height. However, it is preferable to set the height of the outer projections 31*b* at the trailing end of the sheets around 6 mm to guarantee prevention of the re-fusing action, even if the sheets 33 are stacked in a wavy manner due to having a high temperature and high moisture content. As long as the air intake space is present, the sheets 33 will be cooled by air.

Also, as shown in FIG. 6B, where the projections 31*a* and 31*b* has same lengths, the air intake space becomes extremely narrow (as shown by an arrow G) because sheets 33 that are curled due to the heat by the fuser cover the entire projections 31*a* and 31*b*. Thus, cooling is insufficient due to poor air flow.

As FIG. 7 shows, the trench 32 is formed between the two inner projections 31*a*, and the trench is 7 mm in depth. A middle layer of the sheet stack at the trailing edge of the sheets 33 tends to maintain a relatively high temperature. However, the trench 32 facilitates cooling of the bottom layer of the stack. With this configuration, every sheet 33 that is discharged is cooled by contact with sheets 33 that have already been stacked and cooled as described above. Consequently, the entire stack is cooled.

Further, making the outer projections 31*b* shorter than the inner projections 31*a* increases the friction occurring between discharged sheets 33 and the stacking surface (upper surface, or base) of the sheet stacking device 30. The friction prevents the stacked sheets 33 on the sheet stacking device 30 from moving forward due to a dragging force caused by a sheet being discharged.

FIG. 8 shows temperature changes over time in the sheet stacking device 30. Further, FIG. 8 shows temperature changes of the sheets 33 over time. The temperature was measured at the rear edge of the stacked sheets 33 on the sheet stacking device 30. The temperature was measured where the projections 31*a* and 31*b* were 3 mm in height and the trench 32 is 7 mm in depth. In particular, 150 sheets of the sheets 33 were continuously supplied and printed. The temperatures at the rear edge of the 20th sheet (see the line T), 70th sheet (see the line S), and 120th sheet (see the line H) were measured and are displayed in the figure. Also, the temperature measured at the area X shown in FIG. 1 of the sheet stacking device 30 is displayed (see the line X). The toner re-fusing temperature is shown with a solid line R.

FIG. 9 shows, in a condition where the projections 31*a* and 31*b* were 8 mm in height and the trench 32 is 7 mm in depth, temperature changes over time of the sheet stacking device 30 and temperature changes measured at the rear edge of the sheets 33 stacked on the sheet stacking device 30 as in FIG. 8.

A condition where the re-fusing among the stacked sheets by using toner (Product Code: PT071 of Zeon Corporation) occurs is that the stacked sheets 33 are present at over 65° C. for more than 10 minutes. The re-fusing condition of PT071 is above 65° C. degrees for over 10 minutes. Therefore, according to FIG. 8, it is clear that the re-fusing of the sheets 33 will occur in a range of 20th sheet to 120th sheet. The re-fusing condition varies among toner products. Therefore, when a toner for which the re-fusing temperature is lower than 65° C. degrees is used, the re-fusing occurs at a lower temperature. When a toner having a higher re-fusing temperature is used, the re-fusing occurs at the higher temperature.

Comparing the results shown in FIG. 8 with the results shown in FIG. 9, the temperatures of the sheets 33 are initially the same or similar. However, the temperature of the sheet stacking device 30 in FIG. 9 is lower than that in FIG. 8. The difference is caused by differences in air cooling derived from the differing heights of the projections 31*a* and 31*b*. Considering above result, FIG. 9 shows a more effective temperature drop of the sheets 33.

More specifically, part of the line S in FIG. 8 is above the line R (65° C. degrees) for more than 10 minutes, which indicates that re-fusing occurred. On the other hand, in FIG. 9, while there is part of the line H above the line R (65° C. degrees), that condition lasts for less than 10 minutes. Also, there are no lines above the line R for more than 10 minutes in FIG. 9. Thus, no re-fusing occurred.

From the result in FIG. 9, when the projections 31*a* and 31*b* are 8 mm in height and when the trench 32 exists, re-fusing of the sheets 33 does not occur.

As described above, in a configuration of a sheet stacking device 30 in which two types of projections 31*a* and 31*b* are located to extend (longitudinally) in a traveling direction, each having a different height, and further in which a trench 32 is located between the inner projections 31*a*, the sheets 33 stacked on the sheet stacking device 30 are more effectively cooled by air. Thus, the described construction prevents re-fusing of the toner and the resulting sheet adherence.

(Second embodiment) The following is a description of a second embodiment of the sheet stacking device. With respect to the first embodiment, descriptions of identical parts are omitted but are referred with the same reference characters. Descriptions of operations, effects, and functions that are identical in the first embodiment are also omitted.

Figure 10:
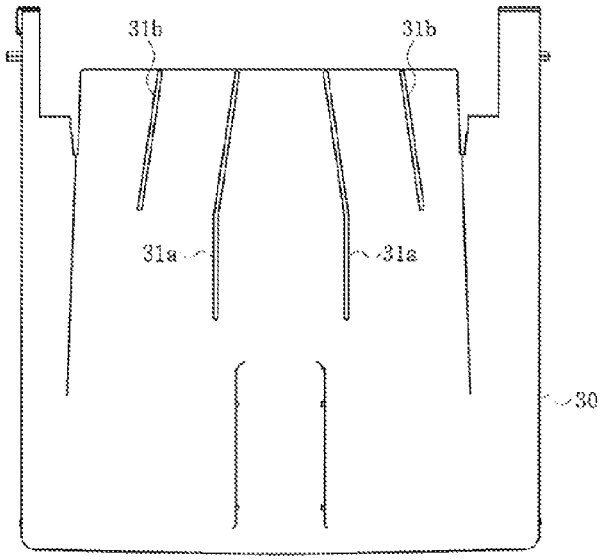
FIG. 10 is a plan view illustrating a sheet stacking device of the second embodiment.

In the first embodiment, the projections 31*a* and 31*b* extend in a direction orthogonal to the axis of the discharge roller 29. In the second embodiment, although the projections 31*c*, 31*d* extend generally in the sheet travel direction, the projections 31*c*, 31*d* are arranged such that the distance between the inner projections 31*c* increases in the sheet travel direction, and the distance between the outer projections 31*d* increases in the sheet travel direction. That is, a distance between the inner projections 31*c* and a distance between the outer projections 31*d*, as measured in the direction of the axis of the discharge roller 29, increases in the travel direction of the sheets. As shown in FIG. 10, the inner projections 31*c* have a parallel arrangement only at a downstream section of the stacking device 30 and are increasingly spaced apart in the travel direction at an upstream section. With such a configuration, the air cooling function is more effective. Accordingly, when users of the image forming device 10 remove the sheets 33 stacked on the sheet stacking device 30, the temperature of the sheets is relatively low as a result of sufficient cooling.

In other respects, the second embodiment is the same as the first embodiment.

The following is a description of the function of the stacking device 30 of the second embodiment.

In the sheet stacking device of the second embodiment of the second embodiment, compared with the first embodiment, the space between the inner projections 31*c* is wider. Similarly, a space between the outer projections 31*d* is also wider. With this configuration, an air intake opening of a trench 32 formed within the inner projections 31*c* is relatively wider, which improves the air cooling function.

Further, the outer projections 31*d* contact the sheet stack in a inclined matter with respect to the sheet travel direction. Thus, the outer projections 31*d* can securely hold a trailing end of the sheets 33 in a relatively high position. The trailing ends of the sheets 33 are held in a relatively high position at all times, even if the sheets 33 are curled and have a wave-like shape, and even if the width of the sheets 33 varies.

Figure 11:
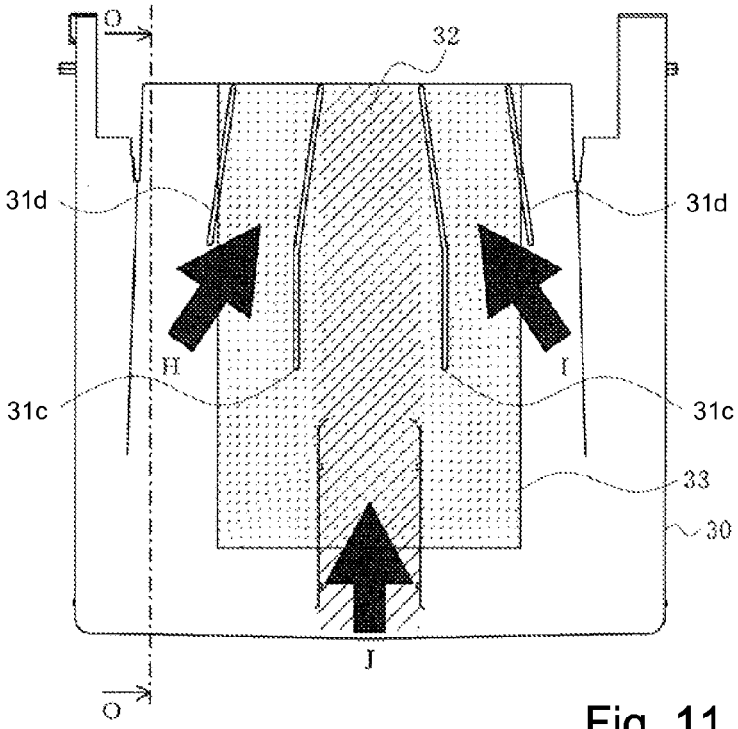
FIG. 11 is a plan view illustrating the sheet stacking device on which sheets are stacked in the second embodiment.
Figure 12:
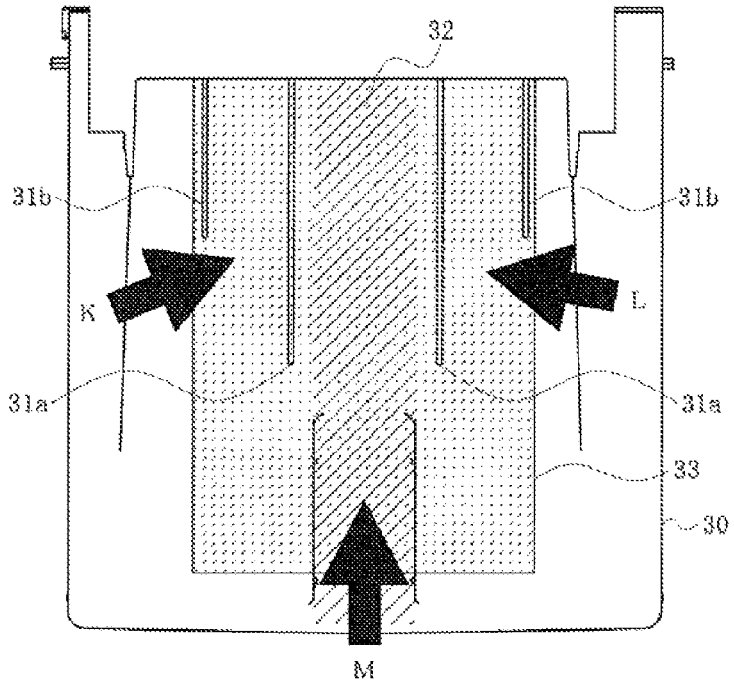
FIG. 12 is a plan view illustrating the sheet stacking device on which sheets are stacked in the first embodiment, for comparison.

FIG. 11 shows a state in which the sheets 33 are stacked on the sheet stacking device 30. Arrows H, I, and J respectively indicate openings into which air can flow. The central are marked with hatching indicates the trench 32 of the sheet stacking device 30. With the configuration in which the outer projections 31*d* are inclined with respect to the sheet travel direction, the trailing ends of the sheets 33 are held in a relatively high position with a minimum but necessary area of contact between the sheets and the outer projections 31*d*. Also, this arrangement makes the air intake opening as wide as possible For comparison, FIG. 12 shows a state of the first embodiment in which the sheets 33 are stacked on the sheet stacking device 30. Arrows K, L, and M respectively indicate openings into which air can flow. A central area marked with hatching indicates the trench 32.

The places indicated with the arrows H and I in FIG. 11 function as air intake openings based on the theory of the air intake gate F shown in FIG. 6A of the first embodiment. By virtue of the inclined projections 31*b* in FIG. 11, the openings indicated by arrows H and I are larger than the openings indicated by arrows K and L in FIG. 12. The larger openings provide more effective cooling.

Figure 13:
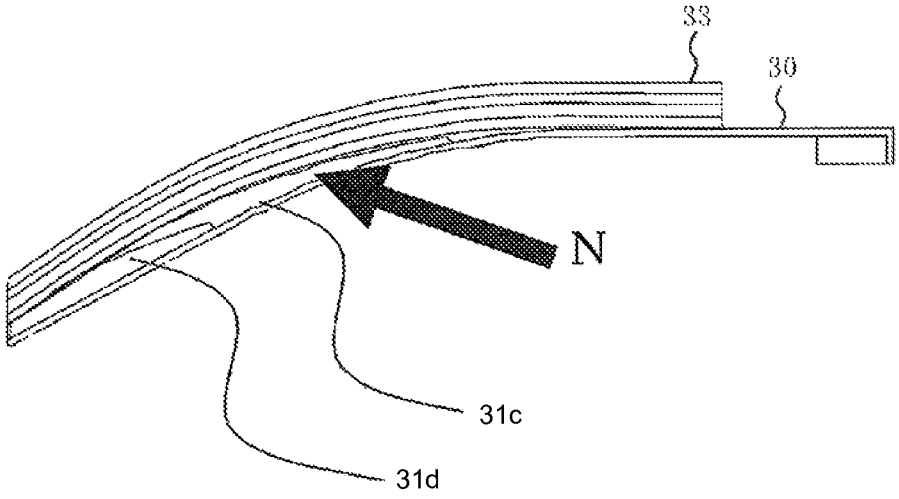
FIG. 13 is a sectional view illustrating the sheet stacking device on which sheet are stacked in the second embodiment, as viewed from plane O-O in FIG. 11.

As shown in FIG. 13, in a sectional view of the sheet stacking device 30, an air intake opening indicated by arrow N is larger than the air intake gate F of the first embodiment shown in FIG. 6A. The air intake opening indicated by arrow N is formed by a space between the sheets 33 and the sheet stacking device 30, and the air intake opening is larger because the outer projections 31*d* are inclined with respect to the longitudinal axis of the stacking device 30. The sheets 33 cooled more effectively by allowing relatively more outer air through the opening indicated by arrow N.

As described above, in the second embodiment, the distance between the inner projections 31*c* and the distance between the outer projections 31*d* increase toward the far end, or downstream end, of the sheet stacking device 30. With this configuration, air cooling of the stack is improved, which prevents re-fusing of the toner and adherence between the sheets 33. Further, the temperature of the sheets 33 stacked on the sheet stacking device 30 becomes relatively lower, which improves the condition of the stacked sheets.

Although the first and second embodiments adapt the invention in printers, the invention may be adapted in various types of image forming devices, as long as a heat application fusing method is used, such as a facsimile machine, a photocopier, and a multi function printer (MFP).

This disclosure is intended to explain how to fashion and use various embodiments in accordance with the invention rather than to limit the true, intended, and fair scope and spirit thereof The invention is defined solely by the appended claims, as they may be amended during the pendency of this application for patent, and all equivalents thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. An image forming unit that forms images on sheets, comprising:

a case including a carrying mechanism that conveys the sheets inside of the case;

a sheet stacking device that includes:

a stacking surface that is part of the case and formed on a surface of the case, and on which the sheets discharged from the case by the carrying mechanism are stacked such that the stacking surface faces an image forming surface of eace of the sheets on which the images are formed;

a plurality of projections that project from the stacking surface and contact the image forming surface of the sheets, at least a pair of the projections extending generally in the travel direction of the sheets; and a trench that is formed in a portion of the stacking surface that is defined by the pair of the projections extending generally in the travel direction of the sheets with respect to a direction that is perpendicular to the travel direction of the sheets, wherein the trench is formed in a substantially linear shape extending in the travel direction of the sheets, the plurality of projections includes at least two outer projections provided so as to extend along the trench, the plurality of projections includes at least two inner projections provided in a region between the outer projections, lengths of the outer projections in the travel direction of the sheets are the same or almost the same, lengths of the inner projections in the travel direction of the sheets are the same or almost the same, and the lengths of the outer projections and the lengths of the inner projections are different.

2. The image forming unit of claim 1, wherein the trench extends generally in parallel to the pair of the projections.

3. The image forming unit of claim 2, wherein all of the projections extend generally in parallel to the travel direction of the sheets.

4. The image forming unit of claim 3, wherein lengths of the pair of the projections defining the trench are substantially identical in the travel direction of the sheets.

5. The image forming unit of claim 4, wherein the projections are symmetrically arranged with respect to the trench.

6. The image forming unit of claim 1, wherein heights of the projections are lower at a downstream location than heights of the projections at a midstream location in the travel direction of the sheets.

7. The image forming unit of claim 1, further comprising:

an outlet that discharges the sheets, wherein the trench is positioned from a region below the outlet toward a downstream side of the travel direction of the sheets, and the trench has a length that is greater than a length of one of the projections.

8. The image forming unit of claim 7, wherein the trench has a length that is greater than lengths of the sheets in the travel direction of the sheets.

9. The image forming unit of claim 1, wherein the stacking surface has a curved portion.

10. The image forming unit of claim 1, wherein among the plurality of projections, lengths of projections at an inner location are longer than lengths of projections at an outer location.

11. The image forming unit of claim 1, wherein the plurality of projections extend to one end of the sheet stacking device.

12. The image forming unit of claim 1, wherein among the plurality of projections, projection heights of projections at an inner location are higher than projection heights of projections at an outer location.

13. The image forming unit of claim 1, wherein projection heights of the outer projections are lower than projection heights of the inner projections.

14. The image forming unit of claim 1, wherein projection heights of the outer projections are lower than projection heights of the inner projections.

15. The image forming unit of claim 1, further comprising:

a fuser that is provided inside of the case and that fuses developer images on the sheets by heat.

16. The image forming unit of claim 1, wherein the outer projections and the inner projections incline towards outside with respect to the travel direction of the sheets.

17. A sheet stacking device for stacking conveyed sheets, comprising:

a stacking surface on which the sheets are stacked;

a plurality of projections that project from the stacking surface, at least a pair of the projections extending generally in a travel direction of the sheets;

a trench that is formed in a portion of the stacking surface that is defined by the pair of the projections with respect to a direction that is perpendicular to the travel direction of the sheets; and a fuser that fuses developer images on the sheets, wherein the fuser is located directly under the stacking surface, the trench is formed in a substantially linear shape extending in the travel direction of the sheets, and at least a portion of the fuser is arranged under a region of the sheet stacking device on which the sheets are accumulated.

18. The sheet stacking device of claim 17, wherein the trench extends generally in parallel to the pair of the projections.

19. The sheet stacking device of claim 18, wherein all of the projections extend generally in parallel to the travel direction of the sheets.

20. The sheet stacking device of claim 19, wherein lengths of the pair of the projections defining the trench are substantially identical in the travel direction of the sheets.

21. The sheet stacking device of claim 20, wherein the projections are symmetrically arranged with respect to the trench.

22. The sheet stacking device of claim 17, wherein heights of the projections are lower at a downstream location than heights of the projections at a midstream location in the travel direction of the sheets.

23. The sheet stacking device of claim 17, further comprising:

an outlet that discharges the sheets, wherein the trench is positioned from a region below the outlet toward a downstream side of the travel direction of the sheets, and the trench has a length that is greater than a length of one of the projections.

24. The sheet stacking device of claim 23, wherein the trench has a length that is greater than lengths of the sheets in the travel direction of the sheets.

25. The sheet stacking device of claim 17, wherein the stacking surface has a curved portion.

26. The sheet stacking device of claim 17, wherein among the plurality of projections, lengths of projections of some of the plurality of projections are different.

27. The sheet stacking device of claim 26, wherein among the plurality of projections, lengths of projections at an inner location are longer than lengths of projections at an outer location.

28. The sheet stacking device of claim 26, wherein the plurality of projections extend to one end of the sheet stacking device.

29. The sheet stacking device of claim 26, wherein among the plurality of projections, projection heights of projections at an inner location are higher than projection heights of projections at an outer location.

30. The sheet stacking device of claim 17, wherein at least a portion of the fuser is arranged directly below a region of the sheet stacking device on which the sheets are accumulated.

* * * * *